US011348704B2

(12) United States Patent
Furukawa

(10) Patent No.: US 11,348,704 B2
(45) **Date of Patent: *May 31, 2022**

(54) PRODUCTION METHOD FOR INSULATED ELECTRIC WIRE AND INSULATED ELECTRIC WIRE

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Toyoki Furukawa, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/242,390

(22) Filed: Apr. 28, 2021

(65) Prior Publication Data

US 2021/0249154 A1 Aug. 12, 2021

Related U.S. Application Data

(63) Continuation of application No. 16/628,732, filed as application No. PCT/JP2018/026425 on Jul. 13, 2018, now Pat. No. 11,024,446.

(30) Foreign Application Priority Data

Jul. 26, 2017 (JP) ..... JP2017-144607

(51) Int. Cl.
*H01B 7/02* (2006.01)
*H01B 7/285* (2006.01)
(Continued)

(52) U.S. Cl.
CPC ..... *H01B 7/285* (2013.01); *H01B 7/0009* (2013.01); *H01B 13/0036* (2013.01); *H01B 13/32* (2013.01)

(58) Field of Classification Search
CPC .... H01B 7/285; H01B 7/009; H01B 13/0036; H01B 13/32
(Continued)

(56) References Cited

U.S. PATENT DOCUMENTS 4,461,736 A * 7/1984 Takagi ..... B29C 44/12 156/48
5,536,904 A 7/1996 Kojima et al.
(Continued)

FOREIGN PATENT DOCUMENTS

CN 103907161 A 7/2014
DE 102011083952 A1 4/2013
(Continued)

OTHER PUBLICATIONS

Sep. 25, 2018 International Search Report issued in International Patent Application No. PCT/JP2018/026425.
(Continued)

*Primary Examiner* — William H. Mayo, III
(74) *Attorney, Agent, or Firm* — Oliff PLC

(57) ABSTRACT

An insulated electric wire includes a conductor of a plurality of twisted elemental wires made of a conductive material, and an insulation covering. The wire includes an exposed portion in which the insulation covering is removed, and a covered portion in which the insulation covering covers the conductor. The exposed portion and the covered portion are
(Continued)

adjacent with each other along a longitudinal axis of the wire. The covered portion includes an adjacent area located adjacent to the exposed portion, and a remote area located adjacent to the adjacent area and apart from the exposed portion. A density of the conductive material per unit length is higher in the exposed portion than in the remote area. The elemental wires are twisted in both the exposed portion and the remote area. Gaps between the elemental wires of the exposed portion are filled with a sealant.

19 Claims, 7 Drawing Sheets

(51) Int. Cl.
*H01B 7/00* (2006.01)
*H01B 13/00* (2006.01)
*H01B 13/32* (2006.01)

(58) Field of Classification Search
USPC ..... 174/36, 110 R–110 Pm, 120 R–121 SR
See application file for complete search history.

(56) References Cited

U.S. PATENT DOCUMENTS 5,846,467 A * 12/1998 Saito ..... B60R 16/0222 264/263
2010/0032185 A1 2/2010 Hashimoto et al.
2010/0212936 A1 8/2010 Arai
2010/0307815 A1 12/2010 Gehrke et al.
2011/0048762 A1* 3/2011 Sawamura ..... H01R 4/72 174/78
2012/0061122 A1 3/2012 Kodama et al.
2014/0299353 A1* 10/2014 Saito ..... H01B 7/285 174/113 R
2016/0329129 A1 11/2016 Osborne, Jr. et al.
2018/0097344 A1 4/2018 Daga et al.

FOREIGN PATENT DOCUMENTS

JP 2000-011771 A * 1/2000 ..... H01B 13/00
JP 2000-11771 A 1/2000
JP 2007-141569 A 6/2007
JP 2009-135073 A 6/2009
JP 2013-097922 A 5/2013
JP 2014-519137 A 8/2014
JP 2019-29093 A 2/2019

OTHER PUBLICATIONS

Feb. 19, 2019 Office Action issued in Japanese Patent Application No. 2017-144606.
Sep. 25, 2018 International Search Report issued in International Patent Application No. PCT/JP2018/026424.
Mar. 12, 2020 Office Action issued in Indian Patent Application No. 201917049698.
U.S. Appl. No. 16/618,995, filed Dec. 3, 2019 in the name of Toyoki FURUKAWA.
May 12, 2020 Office Action issued in Chinese Patent Application No. 201880045942.8.
Aug. 4, 2020 Office Action issued in Japanese Patent Application No. 2017-144607.
Aug. 31, 2020 Office Action issued in Indian Patent Application No. 202017005674.
Oct. 6, 2020 U.S. Office Action issued U.S. Appl. No. 16/618,995.
Sep. 2, 2020 Office Action issued in Chinese Patent Application No. 201880045938.1.
Nov. 16, 2020 Office Action issued in German Patent Application No. 11 2018 003 812.2.

* cited by examiner

PRODUCTION METHOD FOR INSULATED ELECTRIC WIRE AND INSULATED ELECTRIC WIRE

CROSS-REFERENCE

This application is a Continuation of U.S. patent application Ser. No. 16/628,732 filed Jan. 6, 2020, which is a National Stage Entry of PCT/JP2018/026425 filed Jul. 13, 2018, which claims priority to JP 2017-144607 filed Jul. 26, 2017. Each of the prior applications is hereby incorporated by reference in its entirety.

TECHNICAL FIELD

The present invention relates to a production method for an insulated electric wire and an insulated electric wire, and more specifically to a production method for an insulated electric wire having a portion where an insulation covering is removed and water-stopping treatment is applied using a sealant, and an insulated electric wire manufactured by such method.

BACKGROUND ART

In some cases, water-stopping treatment is partially applied to an insulated electric wire in the longitudinal axis of the wire. Conventionally, in these cases, an insulation covering 93 is removed from an insulated electric wire 91 at a position where a water-stopped portion 94 is to be formed to expose a conductor 92. Then, a sealant (i.e., water-stopping agent) 95 is permeated between elemental wires constituting the conductor 92, as shown in FIG. 4. A method for making the sealant 95 permeate between elemental wires is, for instance, disclosed in Patent Document 1.

Further, a protective member 99 such as a shrinkable tube is often placed around the water-stopped portion 94 where the sealant 95 is introduced between the elemental wires. In such cases, the protective material 99 plays a roll of physically protecting the water-stopped portion 94, and also a roll of stopping water from between the conductor 92 and the insulation covering 93 adjacent to the portion where the conductor 92 is exposed.

CITATION LIST

Patent Literature

Patent Document 1: JP 2007-141569 A

SUMMARY OF INVENTION

Technical Problem

When the water-stopping treatment is applied as described above, the sealant needs to fully permeate between elemental wires constituting the conductor. To this end, a low-viscosity sealant needs to be used. Thus, the type of available sealants is limited.

Degree of permeation of a sealant between the elemental wires tends to vary depending on the portions and electric wires to which the sealant is applied, whereby reliability of a water-stopping performance is lowered. In Patent Document 1, with the aim of achieving thorough permeation of a sealant even into small gaps between elemental wires, a part of an electric wire is accommodated in a pressure chamber. While a gas is introduced into the pressure chamber and released outside of the pressure chamber passing inside an insulation covering of the coated electric wire, the sealant made of a hot-melt material is forced to permeate between the electric wires. If such special method is used, the process of the water-stopping treatment will be complicated even though a sealant thoroughly permeates between the elemental wires.

An object of the present invention is to provide a production method for an insulated electric wire that enables a sealant to permeate between elemental wires with efficiency and high uniformity when a water-stopping treatment is applied to the insulated electric wire using a sealant, and to provide an insulated electric wire that exhibits an excellent water-stopping performance at a portion between the elemental wires where the water-stopping treatment is applied.

Solution to Problem

In order to solve the foregoing problem, the production method for an insulated electric wire, the electric wire containing a plurality of twisted elemental wires made of a conductive material, and an insulation covering covering an outer surface of the conductor, the method containing: a partial exposure step of forming an exposed portion in which the insulation covering is removed from the outer surface of the conductor, and a covered portion in which the insulation covering covers the outer surface of the conductor, with the exposed portion and the covered portion adjacent with each other along a longitudinal axis of the insulated electric wire; a density modification step of increasing spacing between the elemental wires in the exposed portion, while increasing a density of the conductive material per unit length in the exposed portion; and a filling step of filling gaps between the elemental wires in the exposed portion with a sealant comprising an insulated material.

It is preferable that in the density modification step, a tightening step of tightening a twist of the elemental wires in the exposed portion is performed, and then a loosening step of loosening the twist of the elemental wires in the exposed portion is performed, whereby the spacing between the elemental wires in the exposed portion is increased while the density of the conductive material per unit length in the exposed portion is increased.

It is preferable that the covered portion contains: an adjacent area located adjacent to the exposed portion; and a remote area located adjacent to the adjacent area and apart from the exposed portion, and wherein after the density modification step, the density of the conductive material per unit length becomes highest in the exposed portion, second highest in the remote area, and lowest in the adjacent area. In this case, the exposed portion is preferably provided at a middle portion along the longitudinal axis of the insulated electric wire, and the adjacent areas and the remote areas are provided in the covered portions located on both sides of the exposed portion.

It is preferable that a retightening step of reducing the spacing between the elemental wires of the exposed portion is further performed after the filling step. In this case, by the retightening step, a twist pitch of the elemental wires in the exposed portion is preferably made smaller than in the adjacent area. Furthermore, it is preferable that the sealant contains a curable resin composition, and after the filling step is performed with the use of the sealant, the retightening step is performed before or during curing of the sealant.

It is preferable that in the filling step, the sealant further covers the outer surface of the conductor, and the portion of the sealant covering the outer surface of the conductor and the portion of the sealant filling the gaps between the elemental wires are continuous in the exposed portion. In this case, after the filling step, a covering movement step is performed in which the insulation covering in the covered portion is moved toward the exposed portion to contact an end portion of the insulation covering with the sealant disposed in the exposed portion, whereby the outer surface of the exposed portion become covered with the sealant continuously together with the outer surface of the insulation covering of the end portion in the covered portion continuously.

It is preferable that the filling step is performed with the sealant having a viscosity of 4000 mPa·s or higher.

According to the present invention, an insulated electric wire contains a conductor containing a plurality of twisted elemental wires made of a conductive material, and an insulation covering covering an outer surface of the conductor, the insulated electric wire comprising: an exposed portion in which the insulation covering is removed from the outer surface of the conductor, and a covered portion in which the insulation covering covers the outer surface of the conductor, the exposed portion and the covered portion adjacent with each other along a longitudinal axis of the insulated electric wire, the covered portion containing an adjacent area located adjacent to the exposed portion, and a remote area located adjacent to the adjacent area and apart from the exposed portion, where a density of the conductive material per unit length is higher in the exposed portion than in the remote area, and gaps between the elemental wires of the exposed portion are filled with a sealant made of an insulated material.

In this case, it is preferable that the density of the conductive material per unit length becomes highest in the exposed portion, second highest in the remote area, and lowest in the adjacent area.

It is preferable that a twist pitch of the elemental wires is smaller in the exposed portion than in the adjacent area.

It is preferable that in the exposed portion, the sealant further covers the outer surface of the conductor, and the portion of the sealant covering the outer surface of the conductor and the portion of the sealant filling the gaps between the elemental wires are continuous. In this case, the sealant further covers the outer surface of the insulation covering at an end portion of the covered portion adjacent with the exposed portion, and the portion of the sealant covering the outer surface of the insulation covering at the end portion of the covered portion adjacent with the exposed portion, and the portion of the sealant covering the outer surface of the conductor in the exposed portion are continuous.

It is preferable that the density of the conductive material per unit length in the exposed portion is 1.01 times of the density of the conductive material per unit length in the remote area or higher.

It is preferable that the density of the conductive material per unit length in the exposed portion is 1.50 times of the density of the conductive material per unit length in the remote area or lower.

It is preferable that the exposed portion is placed at a middle portion along the longitudinal axis of the insulated electric wire, and the adjacent areas and the remote areas are provided in the covered portions located on both sides of the exposed portion.

It is preferable that the sealant contains a curable resin composition.

Advantageous Effects of the Invention

In the production method for an insulated electric wire according to the present invention, the spacing between the elemental wires in the exposed portion is increased in the density modification step, and then the gaps between the elemental wires in the exposed portion is filled with the sealant in the filling step. Thus, the sealant permeates the gaps between the elemental wires with high efficiency and uniformity. In particular, even when the sealant has a relatively high viscosity, it can permeate the gaps between the elemental wires easily. Furthermore, since the density of the conductive material per unit length at the exposed portion is increased in the density modification step, the spacing between the elemental wires can be increased large easily. Thus, uniformity of permeation of the sealant between the elemental wires can further be increased.

When in the density modification step, the tightening step of tightening the twist of the elemental wires in the exposed portion is performed, and then the loosening step of loosening the twist of the elemental wires in the exposed portion is performed, whereby the spacing between the elemental wires in the exposed portion is increased while the density of the conductive material per unit length in the exposed portion is increased, the conductor can be fed out toward the exposed portion from the covered portion adjacent to the exposed portion in the tightening step. When the loosening step is then performed, the twist of the elemental wires is loosened while the conductor kept fed out. As a result, an operation to increase the spacing between the elemental wires while increasing the density of the conductive material per unit length in the exposed portion can be performed with efficiency and simplicity.

When the covered portion contains an adjacent area located adjacent to the exposed portion, and the remote area located adjacent to the adjacent area and apart from the exposed portion and after the density modification step, the density of the conductive material per unit length becomes highest in the exposed portion, second highest in the remote area, and lowest in the adjacent area, the density of the conductive material per unit length in the exposed portion is effectively increased by lowering the density of the conductive material per unit length in the adjacent area and shifting the corresponding conductive materials to the exposed portion. As a result, sufficient size of gaps can be created between the elemental wires in the exposed portion, and the sealant smoothly fills the gap.

In this case, when the exposed portion is provided at a middle portion along the longitudinal axis of the insulated electric wire, and the adjacent areas and the remote areas are provided in the covered portions located on both sides of the exposed portion, the conductive material can be shifted to the exposed area from the adjacent areas located on the both sides of the exposed portion. Therefore, sufficient size of gaps can be formed easily between the elemental wires while the density of the conductive material per unit length in the exposed portion is effectively increased.

When, the retightening step of reducing the spacing between the elemental wires of the exposed portion is further performed after the filling step, the sealant effectively stays in the gaps between the elemental wires. Thus, the insulated electric wire achieves an excellent water-stopping performance.

In this case, when by the retightening step, the twist pitch of the elemental wires in the exposed portion is made smaller than in the adjacent area, the sealant effectively stays in the gap between the elemental wires with uniformity without dripping or flowing. Thus, the insulated electric wire achieves a particularly excellent water-stopping performance.

In this case, when the sealant contains a curable resin composition, and, after the filling step is performed with the use of the sealant, the retightening step is performed before or during curing of the sealant, the spacing between the elemental wires can be reduced effectively in the retightening step without interfered by the presence of the sealant, whereby the sealant is cured while kept in the reduced gaps with the spacing between the elemental wires thus reduced. Thus, an excellent water-stopping performance can be obtained.

When, in the filling step, the sealant further covers the outer surface of the conductor, and the portion of the sealant covering the outer surface of the conductor and the portion of the sealant filling the gaps between the elemental wires are continuous in the exposed portion, the sealant on the outer surface of the conductor can play a role as a protective member for protecting the conductor. Thus, water stopping between the elemental wires and protection of the conductor can be achieved conveniently using the common sealant through the common processes. Further, it is not necessary to provide a protective member such as a shrinkable tube on the outer surface of the water-stopped portion as a separate member. Thus, a cost for installing such member is eliminated and also increase of the diameter of an insulated electric wire due to the protective material is eliminated.

In this case, after the filling step, the covering movement step is performed in which the insulation covering in the covered portion is moved toward the exposed portion to contact the end portion of the insulation covering with the sealant disposed in the exposed portion, whereby the outer surface of the exposed portion become covered with the sealant continuously together with the outer surface of the insulation covering of the end portion in the covered portion continuously, a gap which may be formed between the insulation covering of the covered portion and the sealant can be eliminated. At the same time, water stopping can be achieved between the insulation covering and the conductor in the covered portion by the sealant. Accordingly, water stopping between the elemental wires, physical protection of the water-stopped portion, and further water stopping between the conductor and the insulation covering can be achieved conveniently using the common sealant through the common processes. Thus, it is necessary to provide a protective member such as a shrinkable tube on the outer surface of the water-stopped portion as a separate member not only from the viewpoint of the physical protection of the water-stopped portion but also from the viewpoint of water stopping between the conductor and the insulation covering.

When, the filling step is performed with the sealant having a viscosity of 4000 mPa·s or higher, the sealant can stay between the elemental wires with uniformity, providing a high water-stopping performance. Further, since the sealant can stably stay on the outer surface of the conductor and on the outer surface of the insulation covering in the adjacent covered portion, a layer of the sealant on the portions can be formed easily. Even though the sealant has a high viscosity, the sealant can easily permeate the gaps between the elemental wires, because filling of the sealant is performed after increasing the gap between the plurality of elemental wires of the exposed portion while increasing the density of the conductive material per unit length in the exposed portion in the density modification step.

In the insulated electric wire according to the present invention, since the density of the conductive material per unit length is higher in the exposed portion than in the remote area, the wire may be formed by forming a sufficient gap between the elemental wires of the exposed portion and filling the gap with the sealant. Thus, sufficiently large gaps can be formed in the exposed portion between the elemental wires to be filled with the sealant. As a result, the sealant smoothly fills the gaps between the elemental wires of the exposed portion with high uniformity and an excellent water-stopping performance is achieved between the elemental wires.

When the density of the conductive material per unit length becomes highest in the exposed portion, second highest in the remote area, and lowest in the adjacent area, the density of the conductive material per unit length in the exposed portion can be increased effectively by shifting of the conductive material of the adjacent area, in which the density of the conductive material per unit length is the lowest, to the exposed portion. As a result, sufficient size of gaps can be formed easily between the elemental wires in the exposed portion and the sealant fills the gaps with high uniformity. Thus, an excellent water-stopping performance can be effectively achieved.

When the twist pitch of the elemental wires is smaller in the exposed portion than in the adjacent area, the sealant disposed in the gaps between the elemental wires of the exposed portion effectively stays in the gaps. Thus, an excellent water-stopping performance can be effectively achieved.

When, in the exposed portion, the sealant further covers the outer surface of the conductor, and the portion of the sealant covering the outer surface of the conductor and the portion of the sealant filling the gaps between the elemental wires are continuous, the sealant covering the outer surface of the conductor can play a role as a protective member for physically protecting the water-stopped portion. Thus, it will not be necessary to dispose an insulated material as a separate member such as a shrinkable tube on the outer surface of the water-stopped portion.

In this case, with the arrangement where the sealant further covers the outer surface of the insulation covering at the end portion of the covered portion adjacent with the exposed portion, and the portion of the sealant covering the outer surface of the insulation covering at the end portion of the covered portion adjacent with the exposed portion, and the portion of the sealant covering the outer surface of the conductor in the exposed portion are continuous, the sealant can also stop water between the insulation covering and the conductor of the covered portion. Thus, not only from the viewpoint of protecting the water-stopped portion but also from the viewpoint of serving as the member for stopping water between the conductor and the insulation covering, it will not be necessary to dispose a protective material such as a shrinkable tube as a separate member on the outer surface of the water-stopped portion.

When the density of the conductive material per unit length in the exposed portion is 1.01 times of the density of the conductive material per unit length in the remote area or higher, sufficiently large gaps can be formed between the elemental wires to be filled with the sealant. Thus, an excellent water-stopping performance can be effectively achieved.

When the density of the conductive material per unit length in the exposed portion is 1.50 times of the density of the conductive material per unit length in the remote area or lower, the water-stopping performance is improved without excessively increasing the density of the conductive material per unit length in the exposed portion.

When the exposed portion is placed at a middle portion along the longitudinal axis of the insulated electric wire, and the adjacent areas and the remote areas are provided in the covered portions located on both sides of the exposed portion, the conductive material can be shifted from the adjacent areas located on both sides of the exposed portion to the exposed area. Thus, the density of the conductive material per unit length in the exposed portion is increased and sufficient sizes of gaps are likely to be formed between the elemental wires. Accordingly, the sealant is filled in the gaps with uniformity. Thus, an insulated electric wire with an excellent water-stopping performance can be effectively formed.

When the sealant contains the curable resin composition, by placing the sealant in the gaps between the elemental wires in the exposed portion, on the outer surface of the conductor in the exposed portion, and on the outer surface of the insulation covering, an excellent water-stopping performance and a protection performance can be achieved in such areas.

BRIEF DESCRIPTION OF DRAWINGS

FIG. 5A illustrates the wire before formation of a water-stopped portion. FIG. 5B illustrates the partial exposure step.

FIG. 6A illustrates the tightening step. FIG. 6B illustrates the loosening step.

FIG. 7A illustrates the filling step. FIG. 7B illustrates the retightening step.

DESCRIPTION OF EMBODIMENTS

A detailed description of a production method for an insulated electric wire and an insulated electric wire according to a preferred embodiment of the present invention will now be provided with reference to the attached drawings.

[Insulated Electric Wire]

Figure 1:
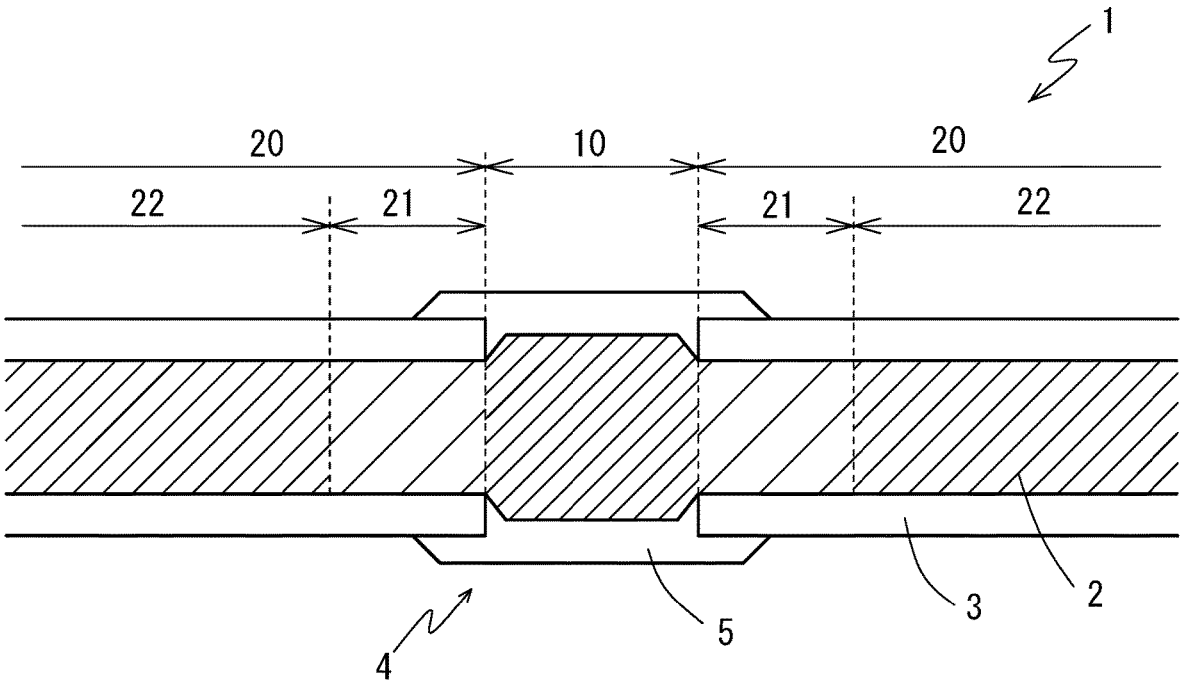
FIG. 1 is a schematic cross-sectional view of an insulated electric wire according to one embodiment of the present invention.
Figure 2:
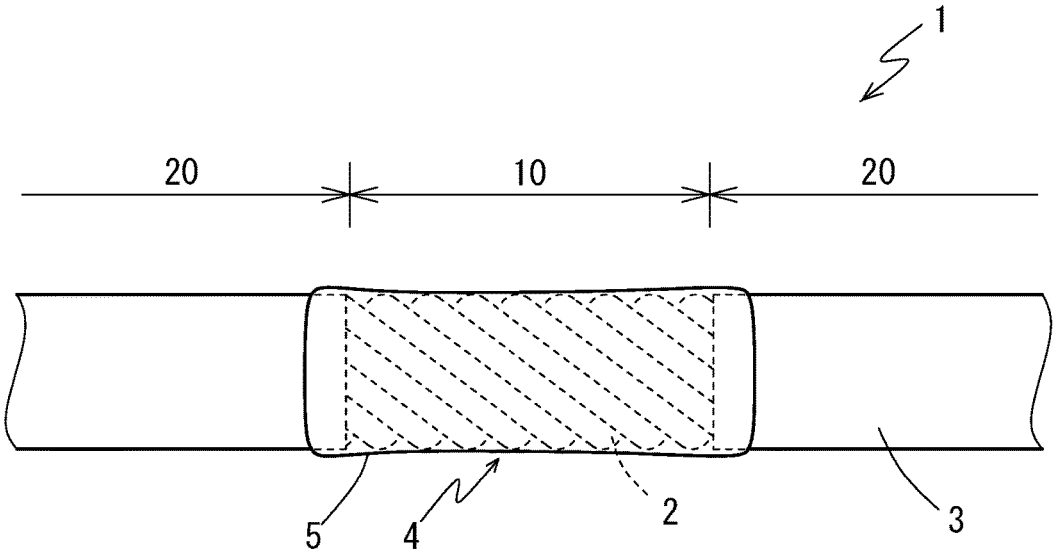
FIG. 2 is a perspective side view illustrating the insulated electric wire.
Figure 3:
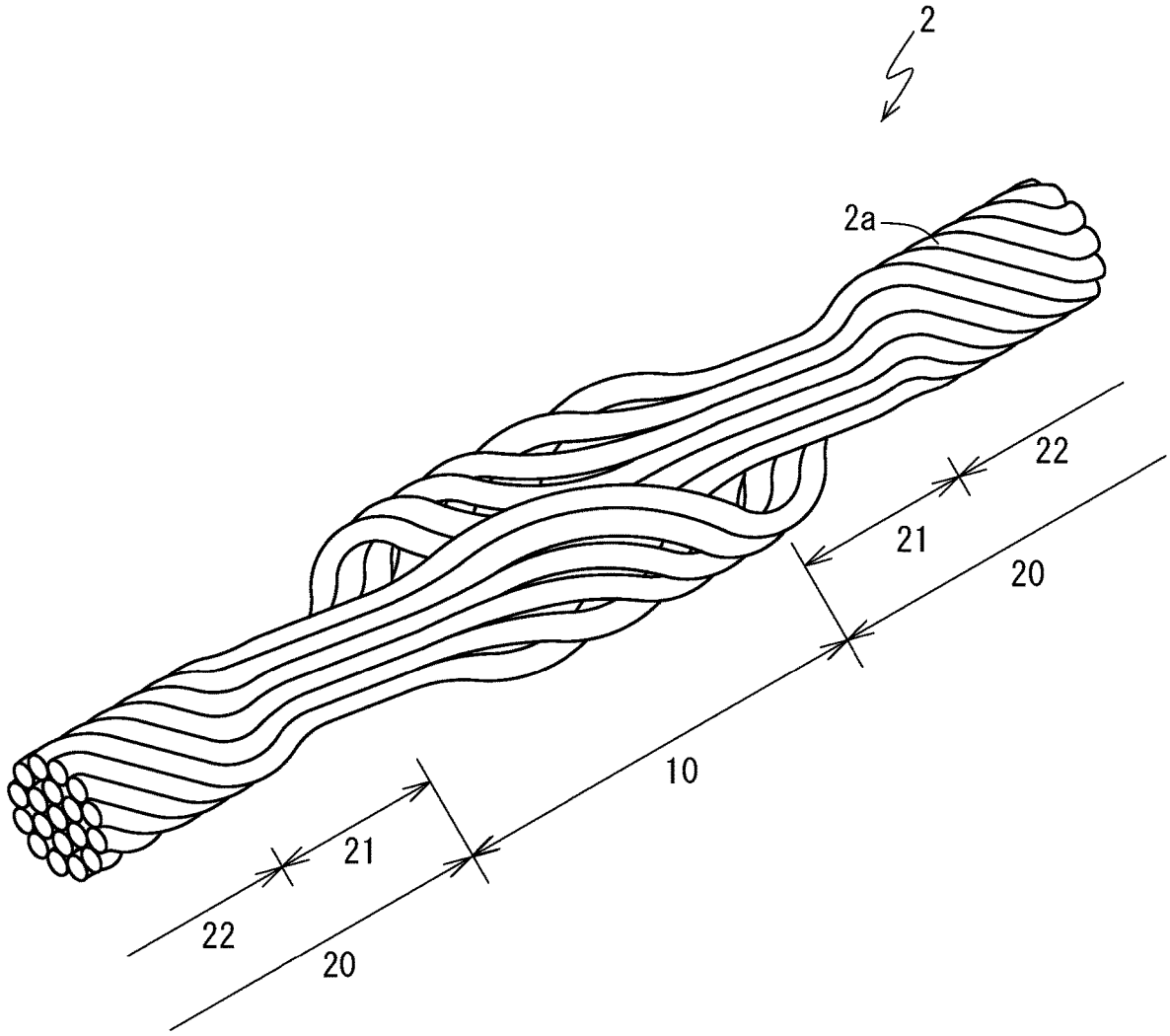
FIG. 3 is a perspective view schematically illustrating a conductor constituting the insulated electric wire.

An insulated electric wire 1 according to a preferred embodiment of the present invention will be described. FIGS. 1 to 3 illustrate overview of an insulated electric wire 1 and a conductor 2 constituting the insulated electric wire 1.

(Overview of the Insulated Electric Wire)

The insulated electric wire 1 contains the conductor 2 and an insulation covering 3 covering the conductor 2. The conductor 2 contains a plurality of elemental wires 2*a* made of a conductive material. The plurality of elemental wires 2*a* are twisted together. A water-stopped portion 4 is formed in the middle portion of the insulated electric wire 1 along the longitudinal axis of the wire 1.

The elemental wire 2*a* constituting the conductor 2 may be made of any kind of conductive material. However, copper is generally used as a material of the conductor of the insulated electric wire. In addition to the copper, metal materials such as aluminum, magnesium and iron may be used. The metal material may be an alloy. Examples of other metals to be used to form an alloy include iron, nickel, magnesium, silicon, and combination thereof. All elemental wires 2*a* may be made of a same kind of metal, or elemental wires 2*a* made of multiple types of metals may be combined together.

In view of easiness in modifying the density of the conductive material and increasing spacing between the elemental wires 2*a* in a density modification step of the production method, which will be described later, it is preferred that the twist structure of the elemental wires 2*a* of the conductor 2 is simple although not particularly limited. For example, a twist structure in which the elemental wires 2*a* are collectively twisted all together is preferred rather than a master-slave twist structure in which a plurality of strands each containing a plurality of twisted elemental wires 2*a* are gathered and further twisted. Further, the whole diameter of the conductor 2 and the diameter of each elemental wire 2*a* are not particularly limited; however, as the diameters of the whole conductor 2 and each elemental wire 2*a* are smaller, the effect and significance of filling minute gaps between the elemental wires 2*a* in the water-stopped portion 4 with a sealant to improve reliability of water stopping becomes higher. Accordingly, it is preferable that a cross section of the conductor is about 8 $mm^2$ or smaller while a diameter of the elemental wire is about 0.45 mm or smaller.

A material constituting the insulation covering 3 is not particularly limited as long as it is an insulating polymer material. Examples of such material include a polyvinyl chloride resin (PVC) and an olefin-based resin. In addition to the polymer material, a filler or an additive may be contained in the covering 3 as appropriate. Further, the polymer material may be cross-linked. Adhesion of the insulation covering 3 to the conductor 2 is preferably not so high to hinder a relative movement between the conductor 2 and the insulation covering 3 in a partial exposure step, density modification step, and the covering movement step in the production method, which will be described later.

The water-stopped portion 4 involves an exposed portion 10 at which the insulation covering 3 is removed from the outer surface of the conductor 2. In the exposed portion 10, gaps between the elemental wires 2*a* constituting the conductor 2 are filled with a sealant 5. In the exposed portion 10, the sealant 5 continuously covers the outer surface of the conductor 2 with the gaps between the elemental wires 2*a*. Further, the sealant 5 further continuously covers the outer surfaces of the insulation covering 3 at end portions of the covered portions 20 adjacent with the exposed portion 10, with an area in the outer surface of the conductor 3 covered by the sealant 5 in the exposed portion 10, that is the outer surface of an end portion of an area in the insulation covering 3 wherein the insulation covering 3 stays on the outer surface of the conductor 2. In this case, the sealant 5 covers the outer surface, preferably the entire outer surface of an area extending from the end portion of the covered portion 20 located on one side of the exposed portion 10 to the end portion of the covered portion 20 located on the other side of the exposed portion 10 continuously. Further, the sealant 5 fills the areas between the elemental wires 2*a* of the exposed portion 10 continuously with covering the outer surfaces portion.

A material contained in the sealant 5 is not particularly limited as long as it is an insulating material that hardly passes a fluid such as water, and exhibits a water-stopping performance; however, it is preferable that the sealant 5 contains an insulating resin composition, and particularly in view of easily filling gaps between the elemental wires 2*a* with keeping high fluidity, the sealant 5 preferably contains a thermoplastic resin composition or a curable resin composition. By placing such resin composition between the elemental wires 2*a* and on the outer peripheries of the exposed portion 10 and the end portions of the covered portion 20 (i.e., on outer peripheral areas), and then lowering the fluidity of the composition, the water-stopped portion 4 with a high water-stopping performance can be stably formed. The curable resin is especially preferred to be used as the sealant 5. It is preferable that the curable resin exhibits at least one or more types of curability such as thermal curability, photocurability, moisture curability, and two-component reaction curability.

The type of a resin contained in the sealant 5 is not particularly limited. Examples of the resin include silicone resins, acrylic resins, epoxy resins, and urethane resins. To the resin material, various kinds of additives can be added appropriately as long as characteristics of the resin material as a sealant are not deteriorated. In view of simplicity of the configuration, it is preferable that only one type of the sealant 5 is used; however, two types of the sealants 5 may be mixed or stacked if necessary.

It is preferable that the sealant 5 is a resin composition having a viscosity of 4000 mPa·s or higher, more preferably 5000 mPa·s or higher, still more preferably 10,000 mPa·s or higher upon filling. Due to this, when the sealant 5 placed at the areas between the elemental wires 2*a* and on the outer peripheral areas, and especially on the outer peripheral areas, the sealant 5 hardly drops or flows and is likely to stay at the areas with high uniformity. On the other hand, it is preferable that the viscosity of the sealant 5 upon filing is suppressed to 200,000 mPa·s or lower since too high fluidity may suppress sufficient permeation of the sealant 5 into the areas between the elemental wires 2*a*.

As described above, when the gaps between the elemental wires 2*a* of the exposed portion 10 are filled with the sealant 5, water stopping is achieved in the areas between the elemental wires 2*a*, preventing a fluid such as water from entering the area. Further, by covering the outer peripheral portion of the conductor 2 at the exposed portion 10, the sealant 5 plays a role of physically protecting the exposed portion 10. Further, by also integrally covering the outer surface of the end portions of the covered portions 20 adjacent to the exposed portion 10, the sealant 5 plays a role of stopping water between the insulation covering 3 and the conductor 2. In other words, the sealant 5 also plays a role of preventing fluid such as water from entering the spacing between the insulation covering 3 and the conductor 2 from outside.

Figure 8:
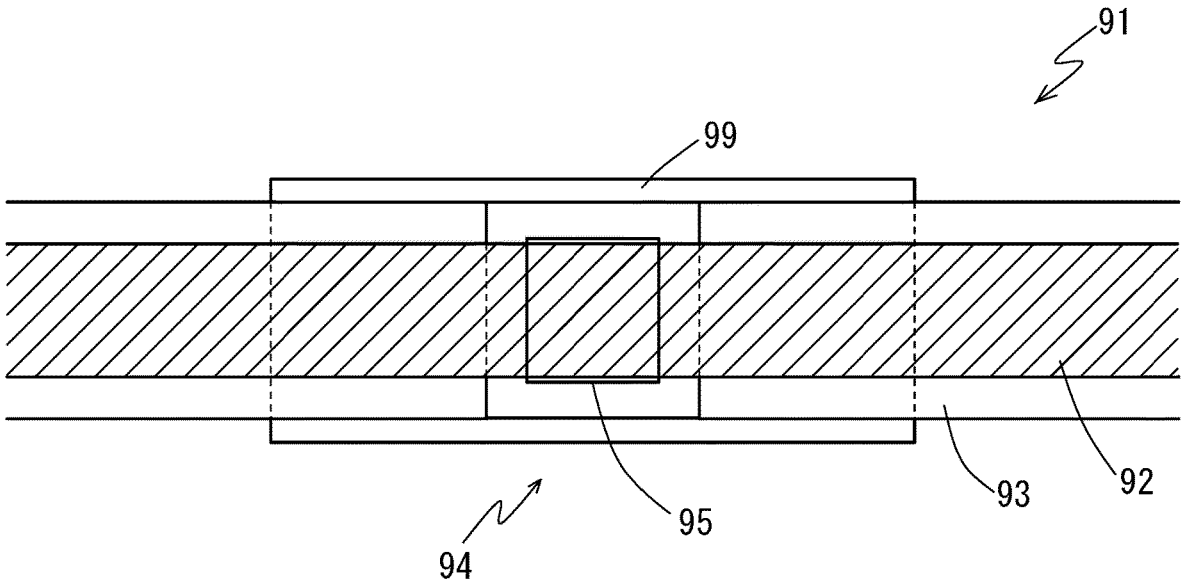
FIG. 8 is a cross-sectional view illustrating a water-stopped portion of a conventional insulated electric wire.

As shown in FIG. 8, in a water-stopped portion 94 of a conventional insulated electric wire 91, a separate protective material 99 such as a shrinkable tube is provided to an outer surface of the portion filled with a sealant 95, for physically protecting the water-stopped portion 94 and stopping water between an insulation covering 93 and a conductor 92. However, as described above, by placing the common sealant 5 in the outer peripheral areas in addition to the area between the elemental wires 2*a*, the sealant 5 plays both rolls as a water-protection material between the elemental wires, and as a protective member, eliminating the necessity to provide a protective material to the outer surface of the water-stopped portion as a separate member. Accordingly, the cost for installing the separate protective member can be eliminated. Further, increase of the diameter of an insulated electric wire 1 caused by placing the protective member, and further increase of the entire diameter of a wiring harness containing the insulated electric wire 1 are prevented. In the present embodiment, however, a protective member may be provided on the outer surface of the sealant 5 as a separate member. Including such cases, the sealant 5 may be disposed only in the gaps between the elemental wires 2*a* without covering the outer peripheral area.

In the present embodiment, the water-stopped portion 4 is provided at a middle portion of the insulated electric wire 1 along the longitudinal axis of the wire 1 from the viewpoints of the scale of demands and degree of effectiveness in increasing the the spacing between the elemental wires 2 by modification of the density of the conductive material per unit length, which will be described later. However, a similar water-stopped portion 4 can be provided to the end portion of the insulated electric wire 1 in the longitudinal axis of the wire 1. In this case, the end portion of the insulated electric wire 1 may be connected to another member such as a terminal fitting or left unconnected. The water-stopped portion 4 covered with the sealant 5 may contain another member such as a connecting member in addition to the conductor 2 and the insulation covering 3. Examples of the case where the water-stopped portion 4 contains another member include a case where the water-stopped portion 4 is provided to a splice portion where a plurality of the insulated electric wires 1 are connected.

(State of Conductor in Water-Stopped Portion)

In the conductor 2 of the insulated electric wire 1 according to the present embodiment, the density of the conductive material per unit length (per unit length of the insulated electric wire 1 in the longitudinal axis) is not uniform and has nonuniform distribution. Each of the elemental wires 2*a* is a wire having a substantially uniform diameter continuously along the entire longitudinal axis of the insulated electric wire 1. In the present specification, a state where the density of the conductive material per unit length is different between areas is defined as a state where the diameter and the number of the elemental wires 2*a* are constant, but the state of assembly of the elemental wires 2*a* such as the state of twist of the elemental wires 2*a* is different.

Specifically, in each of the covered portions 20 adjacent to the both ends of the exposed portion 10, an area located adjacent to the exposed portion 10 is defined as an adjacent area 21 while an area located adjacent to the adjacent area 21 and apart from the exposed portion 10 is defined as a remote area 22. When comparing the exposed portion 10, the adjacent area 21 and the remote area 22 with respect to the density of the conductive material per unit length, the density is highest in the exposed portion 10, second highest int the remote area 22, and lowest in the adjacent area 21. In the remote area 22, the state of the conductor 22 including the density of the conductive material per unit length is substantially the same as the state in the insulated electric wire 1 that does not have the water-stopped portion 4.

FIG. 1 schematically illustrates a state of the conductor 2 having the density distribution of the conductive material as described above. In FIG. 1 and FIGS. 5 to 8, the area inside the conductor 2 is hatched. The higher the density of hatching is, the smaller the twist pitch of the elemental wires 2*a* is, that is, the smaller the spacing between the elemental wires 2*a* is. Further, the larger the width (vertical length) of the area representing the conductor 2 is, the larger the diameter of the conductor 2 is. Those parameters in the drawings are only schematically showing the relation of the size between the areas and are not proportional to the twist pitch of the elemental wires 2*a* or the diameter of the conductor. Furthermore, the parameters in the drawings are discontinuous between the areas, but in the actual insulated electric wire 1, the state of the conductor 2 changes between the areas continuously.

As shown in FIG. 1, the conductor 2 has a larger diameter in the exposed portion 10 than in the remote areas 22 of the covered portions 20. Thus, the elemental wires 2*a* constituting the conductor 2 in the exposed portion 10 are bent and mutually fixed by the sealant 5 in the bent state. Due to the bending of the elemental wires 2*a*, the density of the conductive material per unit length is higher in the exposed portion 10 than in the remote areas 22. That is, amass of the conductive material contained per unit length of the conductor 2 is increased. The density of the conductive material per unit length of the conductor 2 is lower in the adjacent area 21 than in the remote area 22. The diameter of the conductor 2 is smaller in the adjacent area 21 than in the exposed portion 10. In many cases, the diameter of the conductor 2 in the adjacent area 21 is almost same as or smaller than the one in the remote area 22.

Although the details will be described in the next section about the production method for an insulated electric wire, since the density of the conductive material per unit length is higher in the exposed portion 10 than in the remote area 22, sufficient gaps are ensured between the elemental wires 2*a* when the spacing between the elemental wires 2*a* is increased while the diameter of the conductor 2 is enlarged. Thus, the sealant 5 is more likely to permeate into the gaps between the elemental wires 2*a*, and thus the sealant 5 can fill easily and evenly each area of the exposed portion 10 with high uniformity. Accordingly, a highly reliable water stopping can be performed in the areas between the elemental wires 2*a* of the exposed portion 10. From the viewpoint of sufficiently obtaining an effect of the water-stopping performance, the density of the conductive material per unit length in the exposed portion 10 is preferably 1.01 times or larger (101% or larger), more preferably 1.2 times or larger (120% or larger) of the density of the conductive material per unit length in the remote area 22.

On the other hand, if the density of the conductive material per unit length in the exposed portion 10 is excessively high, a load may be applied to the conductor 2 in the exposed portion 10 and the covered portion 20, or the spacing between the elemental wires 2*a* may be too large to keep the sealant 5 in the gaps between the elemental wires 2*a*. Thus, the density of the conductive material per unit length in the exposed portion 10 is preferably 1.5 times or smaller (150% or smaller) of the density of the conductive material per unit length in the remote area 22.

The density of the conductive material per unit length is lower in the adjacent area 21 than in the remote area 22 as described above. This feature has no direct effect in improving the water-stopping performance. However, as will be described in detail in the next section about the production method for the insulated electric wire, the density of the conductive material per unit length ca be lowered in the remote area 21, and the conductive material reduced in the remote area 21 is shifted to the exposed portion 10. Consequently, the density of the conductive material per unit length in the exposed portion 10 can be increased effectively, and a high water-stopping performance is achieved in the area between the elemental wires 2*a* of the exposed portion 10.

Furthermore, the twist pitch of the elemental wires 2*a* is smaller in the exposed portion 10 than in the remote area 22, and thus the spacing between the elemental wires 2*a* of the exposed portion 10 become small, which leads to improvement of the water-stopping performance. This is because if the spacing between the elemental wires 2*a* is reduced when the gaps between the elemental wires 2*a* are filled with the sealant 5 in a state of keeping high fluidity during formation of the water-stopped portion 4, the sealant 5 is effectively kept in the spacing between the elemental wires 2*a* uniformly without dropping or flowing. If the fluidity of the sealant 5 is lowered by curing of the curable resin or the like while keeping the sealant 5 in the gap, a high water-stopping performance can be obtained in the exposed portion 10. The twist pitch of the elemental wires 2*a* in the exposed portion 10 is preferably made smaller than in the adjacent area 21 at least. A relation between the adjacent area 21 and the remote are 22 in terms of the twist pitch of the elemental wires 2*a* is not particularly specified. However, it is preferable that the twist pitch of the elemental wires 2*a* is larger in the adjacent area 21 than in the remote area 22. That is, the twist pitch is preferably smallest in the exposed portion 10, second smallest in the remote area 22 and largest in the adjacent area 21.

[Production Method for Insulated Electric Wire]

A detailed description of a production method for an insulated electric wire according to a preferred embodiment of the present invention will be provided below. In the production method according to the present embodiment, the water-stopped portion 4 of the insulated electric wire 1 according to the aforementioned embodiment can be formed.

Figure 4:
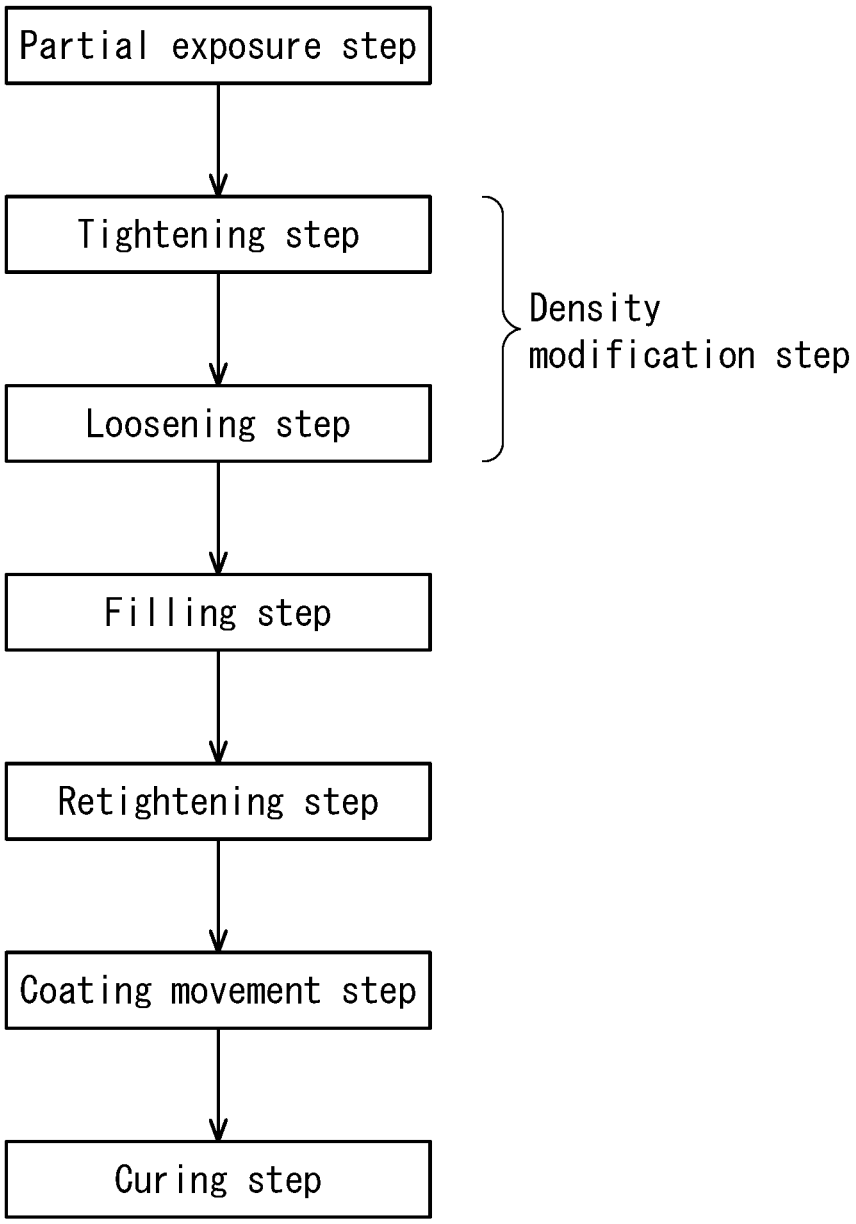
FIG. 4 is a flowchart illustrating steps in the production method for the insulated electric wire according to one embodiment of the present invention.

FIG. 4 schematically illustrates the production method for the insulated electric wire according to the present embodiment. In this method, the water-stopped portion 4 is formed in a partial area of the insulated electric wire 1 along the longitudinal axis of the wire by performing, (1) a partial exposure step, (2) a density modification step, (3) a filling step, (4) a retightening step, (5) a covering movement step, and (6) a curing step, in the description order presented. (2) the density modification step may include (2-1) a tightening step and subsequently (2-2) a loosening step. The steps will be explained below. Though, a case in which the water-stopped portion 4 is formed at a middle portion of the insulated electric wire 1 will be described, specific operations in the steps and the order of the steps may be adjusted as appropriate in accordance with details of the configuration of the water-stopped portion 4 to be formed, such as a position at which the water-stopped portion 4 is to be formed.

(1) Partial Exposure Step

Figure 5A:
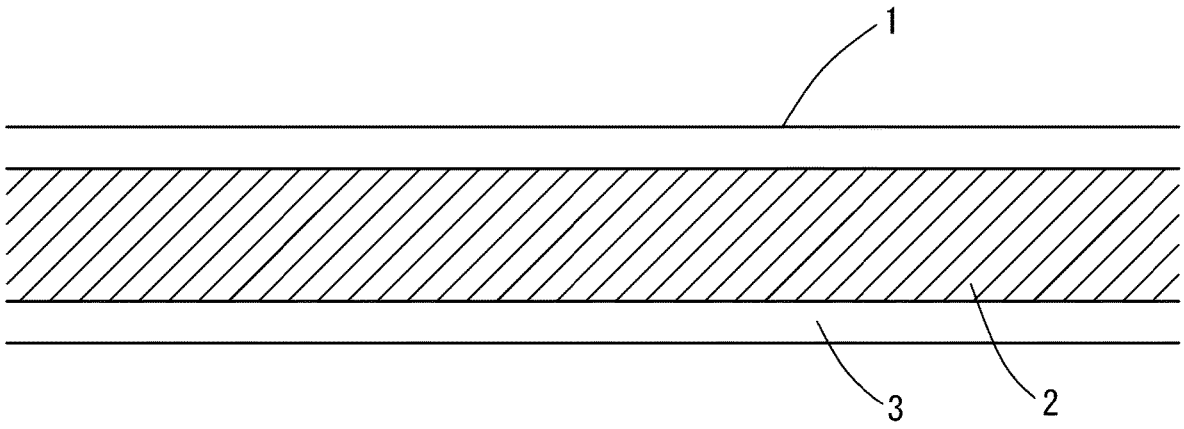
FIGS. 5A and 5B are cross-sectional views of the insulated electric wire for describing the production method.
Figure 5B:
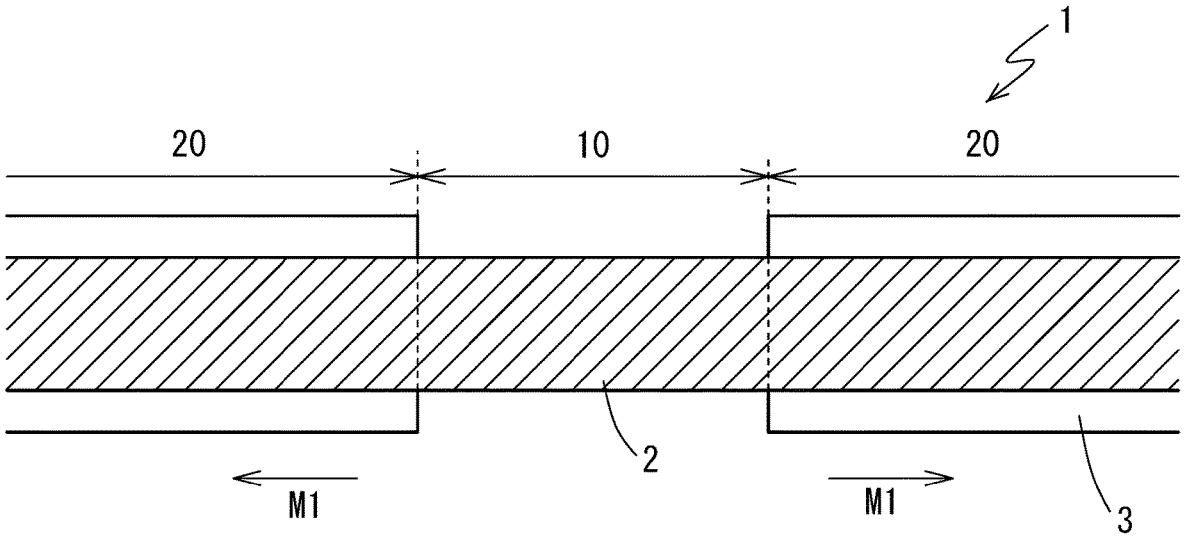

In the partial exposure step, the exposed portion 10 is formed as shown in FIG. 5B on a continuous linear insulated electric wire 1 as shown in FIG. 5A. The covered portions 20 are provided adjacent to both sides of the exposed portion 10 along a longitudinal axis of the wire 1.

In an example of a method for forming the exposed portion 10, a substantially ring-shaped slit is formed on the insulation covering 3 substantially at the center of the area in which the exposed portion 10 is to be formed. During operation, a cut or damage should not be made on the conductor 2. Then, the insulation coverings 3 are held from the outer periphery slit. Then, the coatings 3 are moved along the axial direction of the insulated electric wire 1 to leave a spacing therebetween (movement M1). Along with the movement of the insulation coverings 3, the conductor 2 is exposed between the insulation coverings 33 on the both sides. In such a way, the exposed portion 10 is formed adjacent to the covered portions 20. The length of the exposed portion 10 along the longitudinal axis direction depends on the amount of movement of the insulation coverings 3. Taking into account that the insulation coverings 3 are moved back toward each other in the covering movement step later, the exposed portion 10 is preferably formed longer than the length of the exposed portion 10 expected for the finished product.

(2) Density Modification Step

Next, in the density modification step, a non-uniform distribution of the density of the conductive material is formed between the exposed portion 10, the adjacent areas 21, and the remote areas 22 of the covered portions 20. Further, the spacing between the elemental wires 2*a* of the conductor 2 is increased in the exposed portion 10. Specifically, the non-uniform distribution of the density of the conductive material is formed such that the density of the conductive material per unit length is highest at the exposed portion 10, second highest at the remote area 22, and lowest at the adjacent area 21. Such density distribution can be formed at the same with increase of the spacing between the elemental wires 2*a* in the exposed portion 10 through the tightening step and the subsequent loosening step.

(2-1) Tightening Step

Figure 6A:
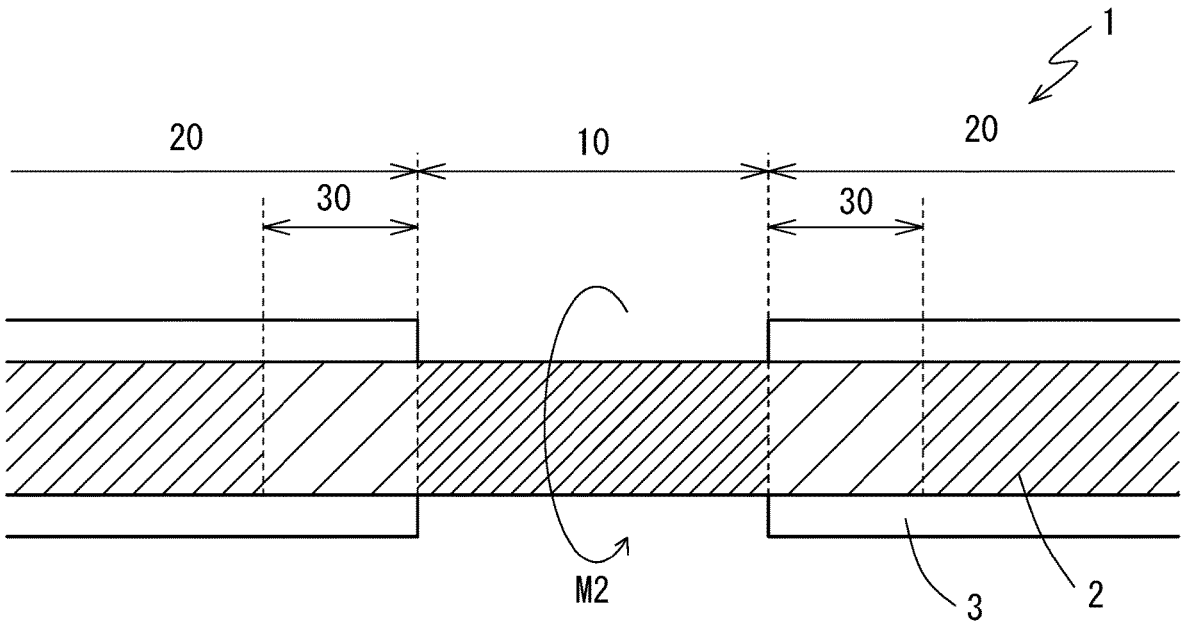
FIGS. 6A and 6B are cross-sectional views of the insulated electric wire for describing the production method.

As shown in FIG. 6A, in the tightening step, the twist of the elemental wires 2*a* in the exposed portion 10 is temporarily tightened further than in the original state. Specifically, the insulated electric wire 1 is wrenched and rotated in the direction of twist of the elemental wires 2*a* to further tighten the twist (movement M2). By this operation, the twist pitch of the elemental wires 2*a* of the exposed portion 10 becomes smaller, and the spacing between the elemental wires 2*a* is reduced.

During this operation, if the covered portions 20 located on the both sides of the exposed portion 10 are held from outside at portions adjacent to the exposed portion 10, and the held portions (i.e., holding portions 30) are wrenched to be rotated in mutually opposite directions, the conductor 2 is fed out from the holding portions 30 toward the exposed portion 10. As a result of the feeding out of the conductor 2, in the holding portions 30, the twist pitch of the elemental wires 2*a* becomes larger than the original pitch and the density of the conductive material per unit length is reduced from the original density, as shown in FIG. 6A. Consequently, the conductive material originally located in the holding portions 30 is partly shifted to the exposed portion 10, and thus the twist pitch of the elemental wires 2*a* in the exposed portion 10 is reduced, and the density of the conductive material per unit length in the exposed portion 10 is increased. In view of smoothly feeding out the conductor 2 from the holding portions 30 toward the exposed portion 10, it is preferable that force to hold the insulated electric wire 1 in the holding portions 30 over the outer periphery of the wire 1 should be suppressed enough to allow the relative movement of the conductor 2 with respect to the insulation covering 3.

(2-2) Loosening Step

Figure 6B:
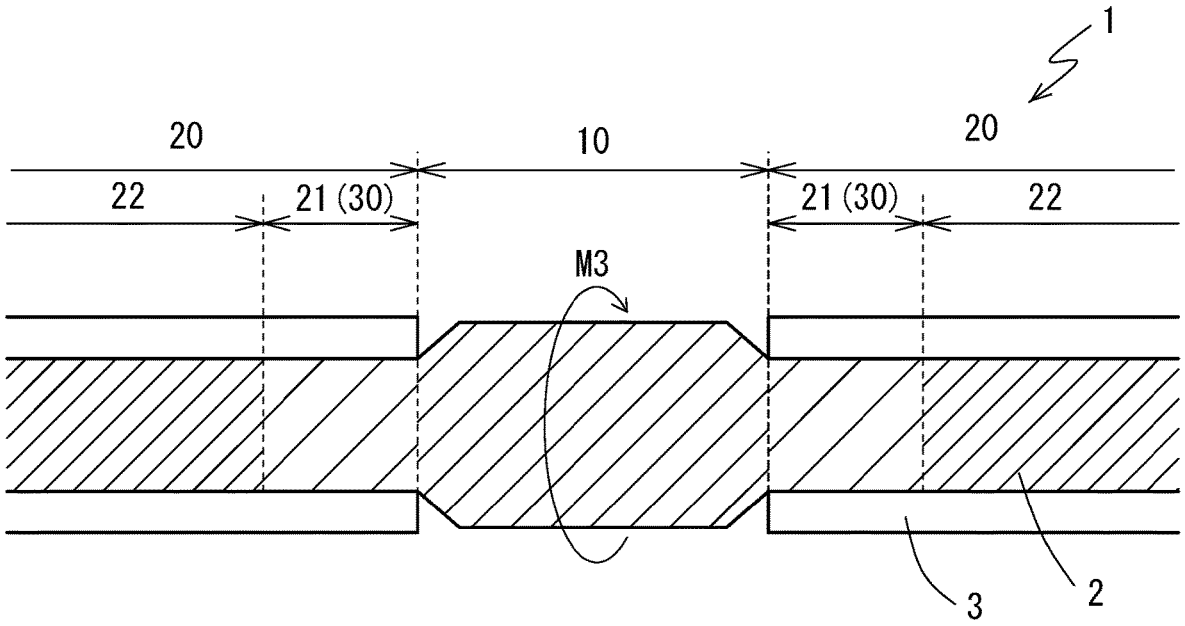

Thereafter, as shown in FIG. 6B, in the loosening step, the twist of the elemental wires 2*a* in the exposed portion 10 is loosened again from a state where the twist has been tightened in the tightening step. The twist can be loosened by simply release the holding of the holding portions 30 or by wrenching and rotating the wire 1 in the direction opposite to the direction in the tightening step, or in other words, the direction opposite to the twist direction of the conductor 2 (movement M3). Either of the methods for loosening the twist may be selected in accordance with the level of tightening in the tightening step, rigidity of the conductor 2, and a desired degree of loosening.

During the operation, the part of the conductor 2 fed out from the holding portions 30 located on the both sides of the exposed portion 10 in the tightening step does not fully return into the area covered with the insulation covering 3 due to rigidity of the conductor 2, and at least partially remains in the exposed portion 10. As a result, the twist of the elemental wires 2*a* of the conductor 2 is loosened with the conductor 2 kept fed out from the exposed portion 10, and thus the elemental wires 2*a* having larger than the length before the tightening step is disposed in the exposed portion 10 in a bent state. That is, as shown in FIG. 6B, in the exposed portion 10, the diameter of the entire area occupied by the conductor 2 becomes larger before the tightening step is performed (in FIG. 5B), and the density of the conductive material per unit length is increased. The twist pitch of the elemental wires 2*a* in the exposed portion 10 becomes larger at least than in the state where the twisting was tightened by the tightening step, depending on the degree of loosening. In view of sufficiently increasing the spacing between the elemental wires 2*a*, the twist pitch of the elemental wires 2*a* in the exposed portion 10 is preferably larger at least than in the state where the twisting was tightened by the tightening step.

After the loosening step, the holding portions 30 in the covered portions 20 at which the insulation covering 3 was held from outside in the tightening step constitutes the adjacent area 21 in which the density of the conductive material per unit length is lower than in the exposed portion 10, and further is lower than in the state before the tightening step. The areas of the covered portions 20 which do not constitute the holding portions 30 in the tightening step, or in other words, the areas spaced apart from the exposed portion 10, are defined as the remote areas 22. In the remote areas 22, the state of the conductor 2 such as the density of the conductive material per unit length and the twist pitch of the elemental wires 2*a* is not changed substantially from the one before the tightening step. For instance, the density of the conductive material per unit length in the exposed portion 10, after subjected to the tightening step and the loosening step, is preferably 1.01 times or larger and 1.5 times or smaller of the density of the conductive material per unit length at the remote area 22.

In this example, the tightening step and the loosening step are performed in the density modification step for forming the exposed portion 10, the adjacent area 21, and the remote area 22, each having different densities of the conductive material per unit length; however, any method can be used as long as the specified modification can be made in the density of the conductive material per unit length. As described above regarding the structure of the insulated electric wire 1, the purpose for which the density of the conductive material per unit length is lower in the adjacent area 21 than in the remote area 22 is increase the density of the conductive material per unit length in the exposed portion 10 effectively. This configuration itself will not contribute to improvement of the water-stopping performance in the water-stopped portion 4. Accordingly, as long as the spacing between the elemental wires 2*a* of the exposed portion 10 can be increased more than in the state before the density modification step is performed, while the density of the conductive material per unit length in the exposed portion 10 is increased higher than in the state before the density modification step is performed, the electric wire 1 does not necessarily need to have the adjacent areas 21 in which the density of the conductive material per unit length is lower than in one of the remote area 22. For example, if the spacing between the elemental wires 2*a* can be increased in the exposed portion 10 while increasing the density of the conductive material per unit length simply by the loosening step, in which the conductor 2 is wrenched and rotated in the direction opposite to the twist direction of the elemental wires 2, then the tightening step may be omitted.

The modification in the density of the conductive material per unit length may be formed by applying post-processing such as wrenching to the insulated electric wire 1 formed as a uniform linear continuous body in the tightening step and the loosening step, or instead, may be introduced in advance in the process of forming the conductor 2. For example, instead of the uniform linear conductor 2, if the way of twisting is changed along the longitudinal axis of the conductor 2 during twisting of the elemental wires 2*a* to form the conductor 2, a conductor 2 having the specified distribution in the density of the conductive material per unit length can be formed. Then, the conductor 2 is covered with the insulation covering 3 on the outer surface, and then subjected to the partial exposure step. Thus, the insulated electric wire 1 can be formed having the exposed portion 10 and the specified distribution in the density of the conductive material per unit length in the exposed portion 10 and the covered portions 20.

(3) Filling Step

Figure 7A:
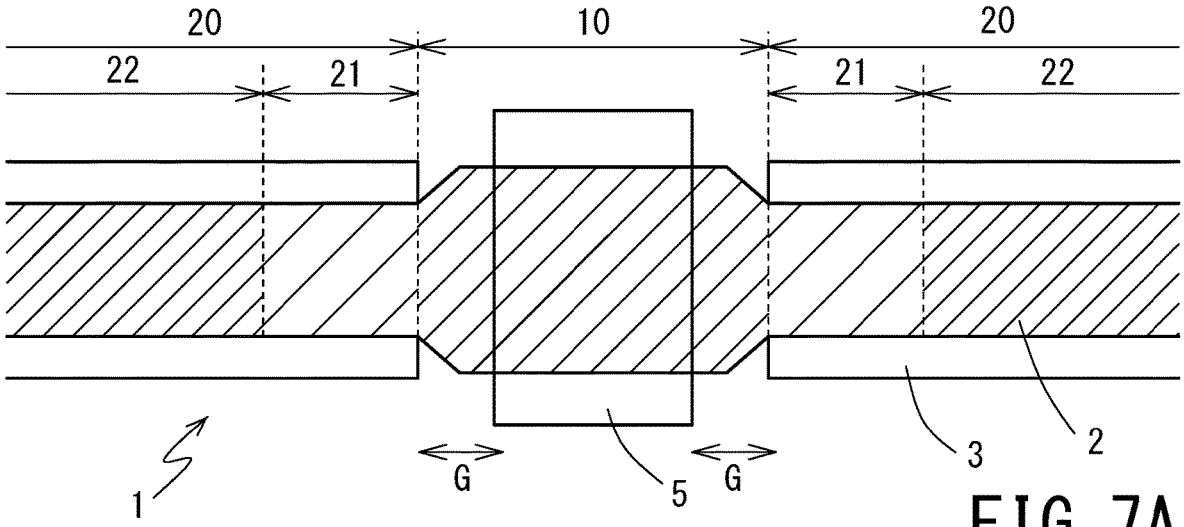
FIGS. 7A to 7B are cross-sectional views of the insulated electric wire for describing the production method.

Next, in the filling step, gaps between the elemental wires 2*a* in the exposed portion 10 are filled with the sealant 5, as shown in FIG. 7A. It is preferable that the sealant 5 permeates into the gap between the elemental wires 2*a* with keeping fluidity. The filling operation using the sealant 5 may be performed through introduction of a resin composition with fluidity into the gaps between the elemental wires 2*a* using an appropriate method such as dripping, coating, and injection according to the property of the sealant 5 such as viscosity.

If the covering movement step is performed after the filling step, the sealant 5 may not necessarily be introduced from one end to the other end of the exposed portion 10 along the longitudinal axis of the insulated electric wire 1. In this case, gaps G in which the sealant 5 is not introduced may be left between the covered portions 20 at either side and the exposed portion 10, as shown in FIG. 7A. Further, during the filling step, there is no need to apply force to any portion of the insulated electric wire 1; however, if the spacing between the elemental wires 2*a* of the exposed portion 10 is reduced by releasing of the force applied to the holding portion 30 (i.e., adjacent area 21) in the aforementioned loosening step, the filling step may be performed with the force applied successively from the loosening step.

In the filling step, it is preferable that the sealant 5 is disposed on the outer surface of the conductor 2 of the exposed portion 10, as well as filling the gaps between the elemental wires 2*a*. To this end, for instance, sufficient amount of the sealant 5 is introduced to the exposed portion 10 to fill the gap between the elemental wires 2*a*, and further to leave extra sealant 5. The sealant 5 may be introduced to preferably from multiple directions along circumference along the exposed portion 10. In this case, the sealant 5 may be provided to the outer peripheral portion of the insulation covering 3 at the end portions of the covered portions 20 in addition to the outer surface of the exposed portion 10. However, if the covering movement step is performed after the filling step, the sealant 5 introduced in the exposed portion 10 may be partially moved onto the outer surface of the insulation covering 3 of the covered portion 20 in the covering movement step. Accordingly, it is enough that the sealant 5 is introduced on the surface of the exposed portion 10 in addition to the gaps between the elemental wires 2*a*.

In the production method according to the present embodiment, the spacing between the elemental wires 2*a* of the exposed portion 10 is increased in the density modification step and then the sealant 5 is introduced into the exposed portion 10 in the filling step. Thus, the sealant 5 easily permeates the space-increased areas between the elemental wires 2*a*. Accordingly, the sealant 5 can easily permeate every part of the exposed portion 10 with high uniformity without unevenness. Consequently, after curing of the sealant 5, the water-stopped portion 4 having an excellent water-stopping performance and high reliability can be formed. Further, uniform permeation of the sealant 5 can be achieved easily without application of any special method such as use of a pressure chamber as described in Patent Document 1.

Further, as described above, even where the sealant 5 has high viscosity upon filling, such as of 4000 mPa·s or higher, and has low fluidity, the sealant 5 can permeate the gap between the elemental wires 2*a* with high uniformity because spacing between the elemental wires 2*a* is increased. Since the high viscous sealant 5 can be used, the type of the usable sealant 5 is increased. When the sealant 5 is introduced not only in the gap between the elemental wires 2*a* but also on the outer surface of the conductor 2 of the exposed portion 10 and the outer surface of the end portions of the covered portions 20, the sealant 5 can stay easily on the outer peripheral portion of the conductor 2 without causing flowing, dripping and the like due to high viscosity. Consequently, the sealant 5 is also provided easily in the outer peripheral portion of the conductor 2 with high uniformity.

(4) Retightening Step

Figure 7B:
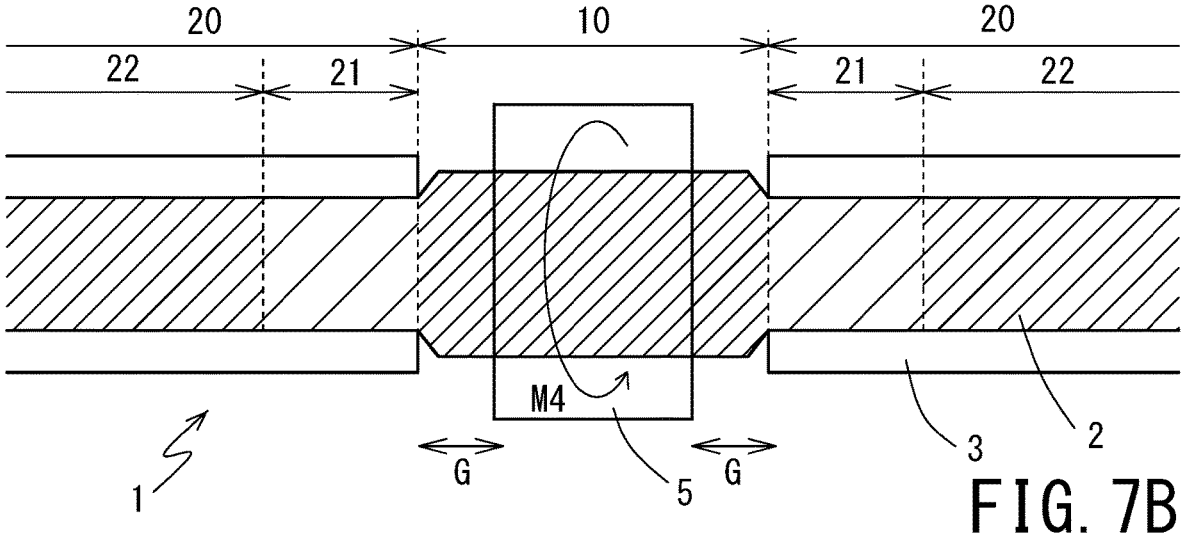

Next, in the retightening step, the spacing between the elemental wires 2*a* is reduced in the exposed portion 10 with the gap between the elemental wires 2*a* filled with the sealant 5, as shown in FIG. 7B. This step, for instance, can be performed similarly with the aforementioned tightening step in the density modification step: the covered portions 20 located on the both sides of the exposed portion 10 are held form the surface of the insulation covering 3 at the adjacent areas 21, and the conductor 2 is wrenched and rotated in the direction of twist of the elemental wires 2*a* to tighten the twist of the elemental wires 2*a* (movement M4). The retightening step is preferably performed while the sealant 5 disposed between the elemental wires 2*a* keeps fluidity. That is, if the sealant 5 contains a curable resin composition, the retightening is preferably performed before or during curing of the sealant 5. Then, the retightening operation is hard to be disturbed by the presence of the sealant 5.

When the gap between the elemental wires 2*a* of the exposed portion 10 is narrowed in the retightening step, the sealant 5 is held in the narrowed gaps. Thus, the sealant 5 stays stably in the gaps between the elemental wires 2*a* without flowing or dripping while the fluidity of the sealant 5 is fully lowered by such as curing. Accordingly, after curing of the sealant 5, the water-stopped portion 4 is formed easily to have an excellent water-stopping performance and high reliability. To increase the effect, it is preferable that the twist pitch of the elemental wires 2*a* of the exposed portion 10 is made smaller in the retightening step. For instance, it is preferable that the twist pitch in the exposed portion 10 after the retightening step is smaller than in one of the adjacent area 21.

If the sealant 5 having a high viscosity is used, a situation hardly occurs where the sealant 5 is expelled from the gap between the elemental wires 2*a* as a result of the re-tightening operation itself. The retightening step may be omitted in such cases where flowing or dripping of the sealant 5 before the fluidity of the sealant 5 is fully lowered is not serious.

(5) Covering Movement Step

Figure 7C:
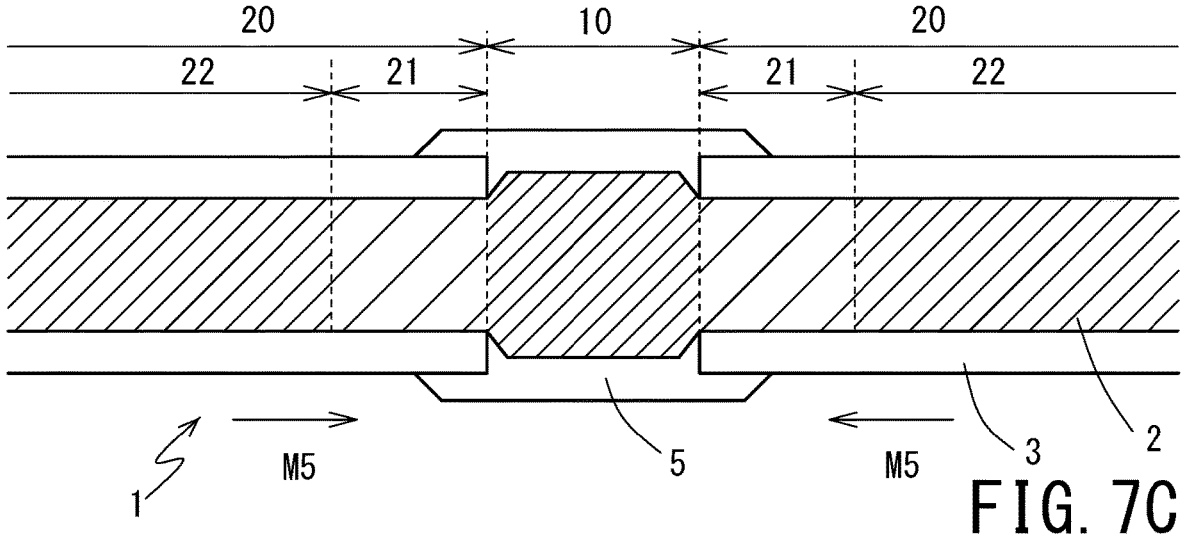
FIG. 7C illustrates the covering movement step.

Next, in the covering movement step, as shown in FIG. 7C, the insulation coverings 3 of the covered portions 20 located on the both sides of the exposed portion 10 are moved towards the exposed portion 10 in a way to bring the coatings 3 close to each other (movement M5). Similarly with the retightening step, the covering movement step is preferably performed while the sealant 5 filling the exposed portion 10 keeps fluidity. That is, if the sealant 5 contains a curable resin composition, the covering movement step is preferably performed before or during curing of the sealant 5. The covering movement step and the retightening step may be performed substantially in a single operation.

Parts of the conductor 2 which were exposed in areas at the both ends of the exposed portion 10 before the coating movement step become covered with the insulation covering 3 by the covering movement step. Furthermore, if the covering movement step is performed while the sealant 5 keeps fluidity, gaps G located at the end portions of the exposed portions 10 where the sealant 5 is not disposed are cancelled by the step, whereby the sealant 5 disposed in the exposed portion 10 is brought into contact with the end portion of the insulation covering 3. As a result, the gaps between the elemental wires 2*a* are filled with the sealant 5 in the entire areas where the conductor 2 is exposed in the exposed portion 10. Furthermore, a part of the sealant 5 disposed on the outer surface of the conductor 2 in the exposed portion 10 can be moved toward the outer surface of the insulation covering 3 in the covered portion 20. Thus, the sealant 5 is continuously disposed in three areas: the gaps between the elemental wires 2*a* of the exposed portion 10, the outer surface of the conductor 2 in the exposed portion 10, and the outer surface of the insulation covering 3 in the end portion of the covered portion 20.

Since the sealant 5 is disposed in the three areas, by the subsequent curing step, the water-stopped portion 4 can be produced that is excellent simultaneously in water-stopping performance in areas between the elemental wires 2, physical protection on the outer surface, and water-stopping performance between the conductor 2 and the insulation covering 3 with the use of the common materials. Since in the covering movement step, the insulation coverings 3 located on the both sides of the exposed portion 10 are moved in a direction in which the coatings 3 become close to each other, the exposed portion 10 in which the spacing between the elemental wires 2*a* is reduced and the gaps between the elemental wires 2*a* are filled with the sealant 5 may extend partially into an area where the insulation covering 3 covers the conductor 2 as well as extending over the area where the conductor 2 is exposed without covered by the insulation covering 3, although a detailed illustration is omitted in FIG. 7C or FIG. 1. The covering movement step may be omitted in such cases where the sealant 5 is introduced to an area extending entirely over the exposed portion 10, or further to an area including the end portions of the covered portions 20 located on the both sides of the exposed portion 10 in the filling step, or where the outer surface of the exposed portion 10 or the outer surface of the covered portion 20 does not require to be covered with the sealant 5.

(6) Curing Step

Finally, the fluidity of the sealant 5 is lowered in the curing step. When the sealant 5 contains a certain type of curable resin composition, a curing method can be adopted according the type of the composition. That is, the sealant 5 may be cured by heating when having thermal curability, by light irradiation when having photocurability, and by humidification such as by exposure to the air when having moisture curability. In some cases, a relatively long period of time is required for curing of the sealant 5 such as where the sealant 5 has a moisture curable property. However, if the sealant 5 has high viscosity, a situation hardly occur where the sealant 5 which not fully cured drips or flows during curing, and does not stay stably between the elemental wires 2*a* of the exposed portion 1 or in the outer surfaces of the exposed portion 10 and the covered portion 20. After the curing step, the insulated electric wire 1 provided with the water-stopped portion 4 having an excellent water-stopping performance can be produced finally.

EXAMPLES

A description of the present invention will now be specifically provided with reference to examples; however, the present invention is not limited to the examples.

Relation between a water-stopping method used in forming a water-stopped portion in an insulated electric wire, and a water-stopping performance achieved by the water-stopped portion was examined.

(Test Method)

(1) Preparation of Samples

An insulated electric wire was prepared by covering the outer surface of a copper stranded conductor having a conductor cross-sectional area of 0.5 $mm^2$ (diameter of elemental wire: 0.18 mm; number of elemental wires: 20) with an insulation covering having a thickness of 0.35 mm made of a polyvinylchloride. Then, an exposed portion having a length of 8 mm was formed at a middle portion of the insulated electric wire. Then, water-stopping treatment was applied to the exposed portion to form a water-stopped portion by the following methods:

In each example and a comparative example, water-stopping treatment was performed as follows:

Example 1: Water-stopping treatment was performed using a high viscosity sealant by a method as shown in the flowchart in FIG. 4, including the tightening step and the loosening step.

Example 2: Water-stopping treatment was performed using a low viscosity sealant by a method as shown in the flowchart in FIG. 4, including the tightening step and the loosening step.

Example 3: A shrinkable tube with adhesive layer was further placed on an outer surface of the water-stopped portion in Example 2.

Example 4: Water-stopping treatment was performed using a low viscosity sealant omitting the tightening step. The spacing between the elemental wires was increased only by the loosening step.

Comparative example 1: Water-stopping treatment was performed simply by introducing a low viscosity sealant into the exposed portion. The tightening step or the loosening step was not performed.

The following two types of sealants were used in the examples and the comparative example:

High-viscosity sealant: A moisture-curable silicone resin having a viscosity of 5000 mPa·s (at 23° C.), "KE-4895" manufactured by Shin-Etsu Chemical Co., Ltd.; Low-viscosity sealant: A moisture-cure acrylic resin having a viscosity of 2 mPa·s (at 23° C.), "7781" manufactured by ThreeBond Co., Ltd.

(2) Evaluation of the Water-Stopping Performance

For the water-stopped portion of each example, a leak test was performed to evaluate the water-stopping performance between the elemental wires, and between the conductor and the insulation covering. Specifically, the water-stopped portion of each insulated electric wire was immersed in water and an air pressure of 150 kPa or 200 kPa was applied from one end of the wire. Then, the water-stopped portion, and the other end of the insulated electric wire to which no air pressure was applied were visually observed.

Upon application of the air pressure of 150 kPa or 200 kPa, if bubbles were not generated either between the elemental wires of the water-stopped portion in the middle portion of the water-stopped portion, or at the end of the insulated electric wire from which air pressure was not applied, the water-stopping performance between the elemental wires was evaluated as "Excellent". Upon application of the air pressure of 150 kPa, if bubbles were not generated at either portion, the water-stopping performance between the elemental wires was evaluated as "Good". Upon application of the air pressure of 150 kPa, if bubbles were generated at at least one of the aforementioned portions, the water-stopping performance of the elemental wires was evaluated as "Poor".

Further, upon application of the air pressure of 150 kPa or 200 kPa, if bubbles were not generated between the conductor and the insulation covering in the end portions of the water-stopped portion, the water-stopping performance between the conductor and the insulation covering was evaluated as "Excellent". Upon application of the air pressure of 150 kPa, if no bubbles were not generated at either portion, the water-stopping performance between the conductor and the insulation covering was evaluated as "Good". Upon application of the air pressure of 150 kPa, if bubbles were generated at at least one of the aforementioned portions, the water-stopping performance between the conductor and the insulation covering was evaluated as "Poor".

(3) Density of Conductive Material in Water-Stopped Portion

For the insulating electric wire of each example and the comparative example, the density of the conductive material per unit length at the water-stopped portion was measured.

First, the length of the water-stopped portion of each insulated electric wire was measured, and then the water-stopped portion was disassembled to isolate the conductor constituting the water-stopped portion. Then, the mass of the isolated conductor was measured (defined as the first mass). Then, a portion having the same length as the water-stopped portion was cut out from the end portion of the insulated electric wire as a part of the remote area. Thereafter, the cut-out portion was disassembled and the mass of the conductor was measured (defined as the second mass). The first mass and the second mass were compared and the value of the first mass was converted with second mass being defined as 100. Thus the value obtained by conversion was defined as a relative density of the water-stopped portion.

(Results)

Table 1 indicates the results of the water-stopping test and the measurement of the conductor density, along with the summary of the water-stopping method. In each box indicating the step of the water-stopping method, "YES" means that the specific step was performed, and "NO" means that the specific step was not performed.

TABLE 1

| | | Example 1 | Example 2 | Example 3 | Example 4 | Relative Example 1 |
|---|---|---|---|---|---|---|
| Water-Stopping Method | Tightening Step | YES | YES | YES | NO | NO |
| | Loosening Step | YES | YES | YES | YES | NO |
| | Sealant | High Viscosity | Low Viscosity | Low Viscosity | Low Viscosity | Low Viscosity |
| | Use of Shrinkable Tube | NO | NO | YES | NO | NO |
| Water-Stopping Performance | Between Elemental Wires | Excellent | Excellent | Excellent | Good | Poor |
| | Between Conductor-Insulation Coating | Excellent | Poor | Excellent | Poor | Poor |
| Relative Density of Water-Stopped Portion | | 130 | 131 | 123 | 101 | 100 |

As shown in Table 1, in Examples 1 to 4 a high water-stopping performance was achieved at least between the elemental wires. It can be deduced that the sealant sufficiently permeated the increased gaps between the elemental wires in the exposed portion having increased spacing therebetween because at least the loosening step was performed. The density per unit length was higher in the exposed portion than in the remote area, which also contributed to increase of the spacing between the elemental wires.

In particular, in Examples 1 to 3, excellent high water-stopping performance was achieved between the elemental wires. It can be deduced that the sealant effectively permeated the gaps between the elemental wires since the spacing between the elemental wires was sufficiently increased in the exposed portion by the tightening step and the loosening step, and the sealant was introduced in the exposed portion while the spacing between the elemental wires increased. The relative density of the water-stopped portion in those samples was approximately 130, and thus the particularly high density of the conductor per unit length in the water-stopped portion is also associated with the increase of the spacing between the elemental wires.

In Example 1, in which a high viscosity sealant was used, a water-stopping performance was excellent between the conductor and the insulation covering as well as between the elemental wires. It was presumably because the sealant had high viscosity, and thus it stayed stably on the outer surface of the conductor of the exposed portion and the outer surface of the insulation covering of the coated portions on the both sides of the exposed portion in the uncured state. Meanwhile, in Example 2 and Example 4, in which a low viscosity sealant was used, sufficient water-stopping performance was achieved between the elemental wires, while sufficient water-stopping performance was not achieved between the conductor and the insulation covering. This is because the sealant did not stably remain at the outer peripheral areas in the uncured state. As in Example 3, a sufficient water-stopping performance was achieved between the conductor and the insulation covering by additional use of a shrinkable tube.

In Comparative example 1, a sufficient water-stopping performance was not achieved between the elemental wires or between the conductor and the insulation covering. It was presumably because the spacing between the elemental wires was not increased, and thus, the sealant did not permeate the spacing between the elemental wires with high uniformity, and further because a low viscosity sealant was used, the sealant was not stably placed on the outer surface of the conductor of the exposed portion or the outer surface of the insulation covering in an area located on the both sides of the covered portion.

The embodiment of the present invention has been described specifically but the present invention is no way restricted to the embodiment described above but can be modified variously within a range not departing from the gist of the present invention.

EXPLANATION OF REFERENCES

1 Insulated electric wire
2 Conductor
2*a* Elemental Wire
3 Insulation covering
4 Water-stopped portion
5 Sealant
10 Exposed portion
20 Covered portion
21 Adjacent area
22 Remote area
30 Holding portion

The invention claimed is:

1. An insulated electric wire comprising:

a conductor comprising a plurality of twisted elemental wires made of a conductive material, and an insulation covering covering an outer surface of the conductor, the insulated electric wire comprising:

an exposed portion in which the insulation covering is removed from the outer surface of the conductor, and a covered portion in which the insulation covering covers the outer surface of the conductor, wherein:

the exposed portion and the covered portion are adjacent with each other along a longitudinal axis of the insulated electric wire, the covered portion comprises an adjacent area located adjacent to the exposed portion, and a remote area located adjacent to the adjacent area and apart from the exposed portion, a density of the conductive material per unit length is higher in the exposed portion than in the remote area, the elemental wires are twisted in both the exposed portion and the remote area including an area that is positioned away from the exposed portion by at least a distance corresponding to a length of the exposed portion, and gaps between the elemental wires of the exposed portion are filled with a sealant made of an insulated material.

2. The insulated electric wire according to claim 1, wherein a twist pitch of the elemental wires is smaller in the exposed portion than in the adjacent area.

3. The insulated electric wire according to claim 1, wherein in the exposed portion, the sealant further covers the outer surface of the conductor, and a portion of the sealant covering the outer surface of the conductor and a portion of the sealant filling the gaps between the elemental wires in the exposed portion are continuous.

4. The insulated electric wire according to claim 3, wherein the sealant further covers an outer surface of the insulation covering at an end portion of the covered portion adjacent with the exposed portion, and a portion of the sealant covering the outer surface of the insulation covering and the portion of the sealant covering the outer surface of the conductor in the exposed portion are continuous.

5. The insulated electric wire according to claim 1, wherein a density of the conductive material per unit length in the exposed portion is 1.01 times of a density of the conductive material per unit length in the remote area or higher.

6. The insulated electric wire according to claim 1, wherein a density of the conductive material per unit length in the exposed portion is 1.50 times of a density of the conductive material per unit length in the remote area or lower.

7. The insulated electric wire according to claim 1, wherein the exposed portion is placed at a middle portion along the longitudinal axis of the insulated electric wire, and the adjacent area and the remote area are provided in the covered portion located on both sides of the exposed portion.

8. The insulated electric wire according to claim 1, wherein the sealant comprises a curable resin composition.

9. The insulated electric wire according to claim 1, wherein the elemental wires are twisted in entirety of the exposed portion and the covered portion.

10. A production method for producing the insulated electric wire of claim 1, the method comprising:

a partial exposure step of forming an exposed portion in which the insulation covering is removed from the outer surface of the conductor, and a covered portion in which the insulation covering covers the outer surface of the conductor, with the exposed portion and the covered portion adjacent with each other along a longitudinal axis of the insulated electric wire;

a density modification step of increasing spacing between the elemental wires in the exposed portion, while increasing a density of the conductive material per unit length in the exposed portion; and a filling step of filling gaps between the elemental wires in the exposed portion with a sealant comprising an insulated material.

11. The production method according to claim 10, wherein in the density modification step, a tightening step of tightening a twist of the elemental wires in the exposed portion is performed, and then a loosening step of loosening the twist of the elemental wires in the exposed portion is performed, whereby the spacing between the elemental wires in the exposed portion is increased while the density of the conductive material per unit length in the exposed portion is increased.

12. The production method according to claim 10, wherein the exposed portion is provided at a middle portion along the longitudinal axis of the insulated electric wire, and the adjacent area and the remote area are provided in the covered portion located on both sides of the exposed portion.

13. The production method according to claim 10, wherein a retightening step of reducing the spacing between the elemental wires of the exposed portion is further performed after the filling step.

14. The production method according to claim 13, wherein by the retightening step, a twist pitch of the elemental wires in the exposed portion is made smaller than in the adjacent area.

15. The production method according to claim 13, wherein the sealant comprises a curable resin composition, and after the filling step is performed with use of the sealant, the retightening step is performed before or during curing of the sealant.

16. The production method according to claim 10, wherein in the filling step, the sealant further covers the outer surface of the conductor, and a portion of the sealant covering the outer surface of the conductor and a portion of the sealant filling the gaps between the elemental wires are continuous in the exposed portion.

17. The production method according to claim 16, wherein after the filling step, a covering movement step is performed in which the insulation covering in the covered portion is moved toward the exposed portion to contact an end portion of the insulation covering with the sealant disposed in the exposed portion, whereby an outer surface of the exposed portion becomes covered with the sealant continuously together with an outer surface of the insulation covering of the end portion in the covered portion continuously.

18. The production method according to claim 10, wherein the filling step is performed with the sealant having a viscosity of 4000 mPa·s or higher.

19. The insulated electric wire according to claim 1, wherein the elemental wires are twisted more tightly in the remote area than in the adjacent area.

* * * * *